US010746203B1

(12) United States Patent
Pelini

(10) Patent No.: US 10,746,203 B1
(45) Date of Patent: Aug. 18, 2020

(54) SIDE INFLOW AND SIDE OUTFLOW HYDRAULIC PUMP

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 360 days.

(21) Appl. No.: 15/954,393

(22) Filed: Apr. 16, 2018

(51) Int. Cl.

| | |
|---|---|
| ***F15B 15/18*** | (2006.01) |
| ***F03C 1/00*** | (2006.01) |
| ***F15B 11/08*** | (2006.01) |
| ***F03C 1/007*** | (2006.01) |
| ***F04C 2/18*** | (2006.01) |

(52) U.S. Cl.
CPC ..... *F15B 15/18* (2013.01); *F03C 1/002* (2013.01); *F03C 1/0073* (2013.01); *F04C 2/18* (2013.01); *F15B 11/08* (2013.01); *F15B 2211/20515* (2013.01)

(58) Field of Classification Search
CPC ..... F15B 2211/20515; F15B 11/08; F15B 15/18; F15B 2211/205–2211/20592; F04C 2/18; F03C 1/002; F03C 1/013; F03C 1/001; F03C 1/007; F03C 1/0073
See application file for complete search history.

(56) References Cited

U.S. PATENT DOCUMENTS

| | | | | |
|---|---|---|---|---|
| 2,918,796 | A * | 12/1959 | Weis | F16D 65/28 60/474 |
| 6,519,939 | B1 * | 2/2003 | Duff | F15B 1/265 60/473 |
| 2012/0067035 | A1 * | 3/2012 | Sweeney | F15B 15/18 60/325 |
| 2015/0135701 | A1 * | 5/2015 | Zammuto | F15B 13/01 60/464 |
| 2015/0275928 | A1 * | 10/2015 | Tsutsui | F15B 15/18 60/471 |
| 2016/0108914 | A1 * | 4/2016 | Ramadoss | F04C 15/008 417/410.4 |

* cited by examiner

*Primary Examiner* — Bryan M Lettman
(74) *Attorney, Agent, or Firm* — Edward P. Dutkiewicz

(57) ABSTRACT

An integrated housing containing a drive motor which is coupled to a pair of gears which are housed within a pump housing. There are a plurality of inflow-outflow openings which are located on opposite sides of the pump, outside of the centroid of the pump housing. A pump housing is continuous with a hydraulic cylinder. Fluid passage ways run through the integrated housing to control the integrated hydraulic cylinder. Valves within the integrated housing regulate fluid flow.

8 Claims, 7 Drawing Sheets

FIG. 6
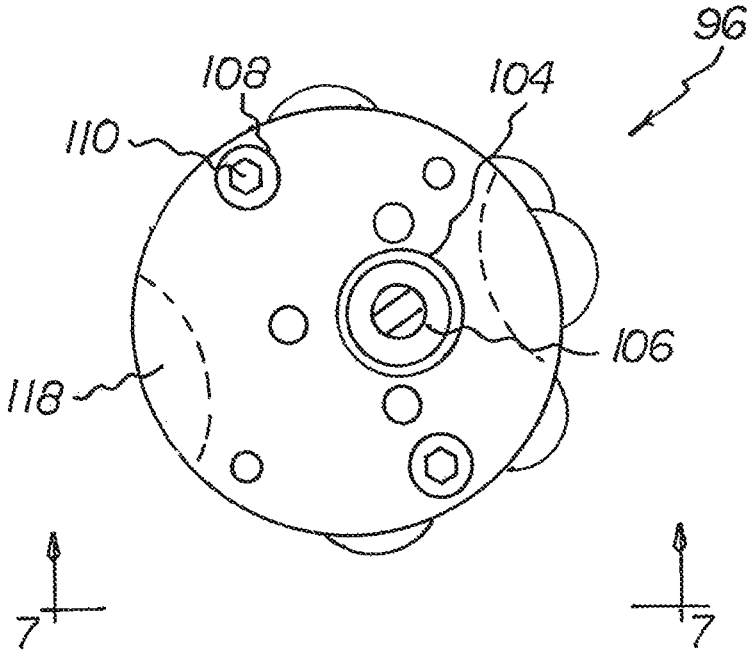
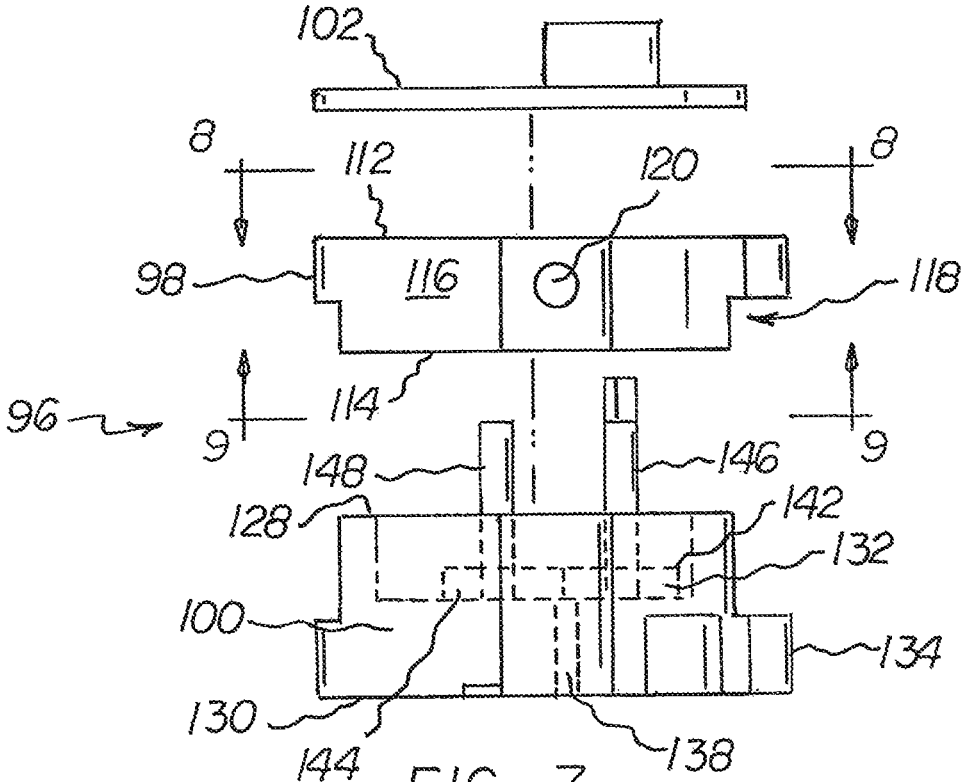
FIG. 7

SIDE INFLOW AND SIDE OUTFLOW HYDRAULIC PUMP

BACKGROUND OF THE INVENTION

Rule 1.78(F) (1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a side inflow and side outflow hydraulic pump and more particularly pertains to a side inflow and side outflow hydraulic pump in an integrated configuration.

DESCRIPTION OF THE PRIOR ART

The use of hydraulic pumps is known in the prior art. More specifically, hydraulic pumps previously devised and utilized for the purpose of using fluid under pressure to do work are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a side inflow and side outflow hydraulic pump in an integrated configuration.

In this respect, the side inflow and side outflow hydraulic pump according to the present invention substantially departs from the conventional concepts and designs of the prior art, and in doing so provides an apparatus primarily developed for the purpose of a side inflow and side outflow hydraulic pump in an integrated configuration.

Therefore, it can be appreciated that there exists a continuing need for a new and improved side inflow and side outflow hydraulic pump in an integrated configuration. In this regard, the present invention substantially fulfills this need.

SUMMARY OF THE INVENTION

In view of the foregoing disadvantages inherent in the known types of hydraulic pumps now present in the prior art, the present invention provides an improved side inflow and side outflow hydraulic pump. As such, the general purpose of the present invention, which will be described subsequently in greater detail, is to provide a new and improved side inflow and side outflow hydraulic pump which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

The term "centroid" is used to describe a volume which is at the center of a container or construct. The container need not be symmetrical, and may have an irregularly shaped inner volume. The centroid is not a point, but an area of uniform density, and in this application the area, or volume, of uniform density, contained within the centroid, is about five percent of the entire volume of the container or construct.

To attain this, the present invention essentially comprises a side inflow and side outflow hydraulic pump, comprising several components, in combination.

There is an electrically driven hydraulic pump motor. The electrically driven motor has a rotating motor output shaft. The motor has a electrical source, and is coupled there to by wires.

There is an integrated housing. The integrated housing has a motor connection portion, a pump housing portion, a hydraulic cylinder portion, and a connecting portion.

The motor connection portion has a motor mounting surface, with an upwardly projecting lip. The motor connection portion has a motor output shaft hole there through.

The pump housing portion has a generally cylindrical outer wall having a thickness. The thickness forms a housing portion inner surface and a housing portion outer surface. The pump housing portion has a bottom. The bottom has an outer surface and an inner surface, with a thickness there between. The pump housing portion has a centroid, that is, the volume center of the pump housing portion. The bottom surface of the pump housing portion has a plurality of fluid passageway openings therein. The bottom thickness has a plurality of fluid passageways there through. The pump housing portion bottom thickness has a plurality of flow valves contained therein. The pump housing portion top surface has an opening, with a generally flexible seal. The flexible seal has a motor output shaft passageway there through. The pump housing portion bottom outer surface has a pair of downwardly projecting coupling tabs continuous there with. The downwardly projecting coupling tabs each have a bolt hole there through. The bottom of the pump housing portion has a plurality of threaded bolt holes there in.

The hydraulic cylinder portion has a generally cylindrical side wall. The hydraulic cylinder portion side wall has an inner surface and an outer surface, with a thickness there between. The hydraulic cylinder portion cylindrical side wall has an upper fluid passageway there through. The hydraulic cylinder portion has a bottom. The hydraulic cylinder portion bottom has an inner surface and an outer surface, with a thickness there between. The bottom thickness of the hydraulic cylinder portion has a lower fluid passageway there through. The hydraulic cylinder portion has a hydraulic ram with a shaft and a piston. The hydraulic cylinder portion has an open upper end with an associated cylinder cap. The cylinder cap has a hydraulic ram hole there through.

The connecting portion is located between the pump housing portion and the hydraulic cylinder portion. The connecting portion is continuous with the pump housing portion and the hydraulic cylinder portion. The connecting portion has an outer surface and a thickness. The connecting portion contains a plurality of fluid flow control valves and a plurality of fluid passageways. The fluid passageways are continuous between the pump housing portion and the hydraulic cylinder portion.

There is a fluid pump. The fluid pump is housed within the pump housing portion adjacent the centroid of the pump housing portion. The fluid pump has an upper portion and a lower portion and a pump cap.

The fluid pump cap has a generally planar disc configuration with an upwardly projecting lip. The upwardly projecting lip of the fluid pump cap encircles a pump drive shaft hole through the fluid pump cap. The fluid pump cap has a plurality of bolt holes there through, with each bolt hole having an associated bolt.

The fluid pump upper portion has a generally disc shaped configuration with a top surface and a bottom surface, with a thickness there between. The fluid pump upper portion has a continuous side surface. The top surface and the bottom surface are generally parallel to each other. The side surface has a pair of generally opposing recesses therein. The side surface has opposingly located inflow-outflow openings there in. The inflow-outflow openings are located orthogonally to the side recesses and are located outside of the centroid of the pump housing portion.

The inflow-outflow openings each have an associated inflow-outflow fluid passageway located within, and through, the thickness of the fluid pump upper portion. Each inflow-outflow fluid passageway has an associated check valve. Each check valve comprises a spring and a ball.

The fluid pump lower portion has a generally disc shaped configuration. The fluid pump lower section has a generally flat upper surface, a generally flat lower surface, and a curved side wall there between. The curved side wall has a plurality of outwardly projecting rounded tabs. The fluid pump lower portion has a thickness between the fluid pump lower portion upper surface and the fluid pump lower portion lower surface. The upper surface of the fluid pump lower portion has a pump gear recess there in and a plurality of inflow-outflow holes there through. The pair of inflow-outflow holes each run from the upper surface of the fluid pump lower portion to the lower surface of the fluid pump lower portion. Each inflow-outflow hole in the lower surface of the fluid pump lower portion has an associated O ring.

The fluid pump has a pump subassembly comprising a drive gear and an idler gear. The drive gear has a gear with a drive shaft coupled thereto. The idler gear has a gear with an idler shaft coupled thereto. The drive shaft is coupled to the output shaft of the electrically driven motor.

The fluid pump cap bolts couple the fluid pump cap, fluid pump upper portion and fluid pump lower portion to each other and to the threaded bolt holes in the bottom of the pump housing portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved side inflow and side outflow hydraulic pump which has all of the advantages of the prior art hydraulic devices, and none of the disadvantages.

It is another object of the present invention to provide a new and improved side inflow and side outflow hydraulic pump which may be easily and efficiently manufactured and marketed.

It is further object of the present invention to provide a new and improved side inflow and side outflow hydraulic pump which is of durable and reliable constructions.

An even further object of the present invention is to provide a new and improved side inflow and side outflow hydraulic pump which is susceptible of a low cost of manufacture with regard to both materials and labor, and which accordingly is then susceptible of low prices of sale to the consuming public, thereby making such side inflow and side outflow hydraulic pump economically available to the buying public.

Even still another object of the present invention is to provide a side inflow and side outflow hydraulic pump in an integrated configuration.

Lastly, it is an object of the present invention to provide a new and improved integrated housing containing a drive motor which is coupled to a pair of gears which are housed within a pump housing. There are a plurality of inflow-outflow openings which are located on opposite sides of the pump, outside of the centroid of the pump housing. A pump housing is continuous with a hydraulic cylinder. Fluid passage ways run through the integrated housing to control the integrated hydraulic cylinder. Valves within the integrated housing regulate fluid flow.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a view along line 6-6 of FIG. 4.

FIG. 7 is a view along line 7-7 of FIG. 6.

The same reference numerals refer to the same parts throughout the various Figures.

DESCRIPTION OF THE PREFERRED EMBODIMENT

Figure 1:
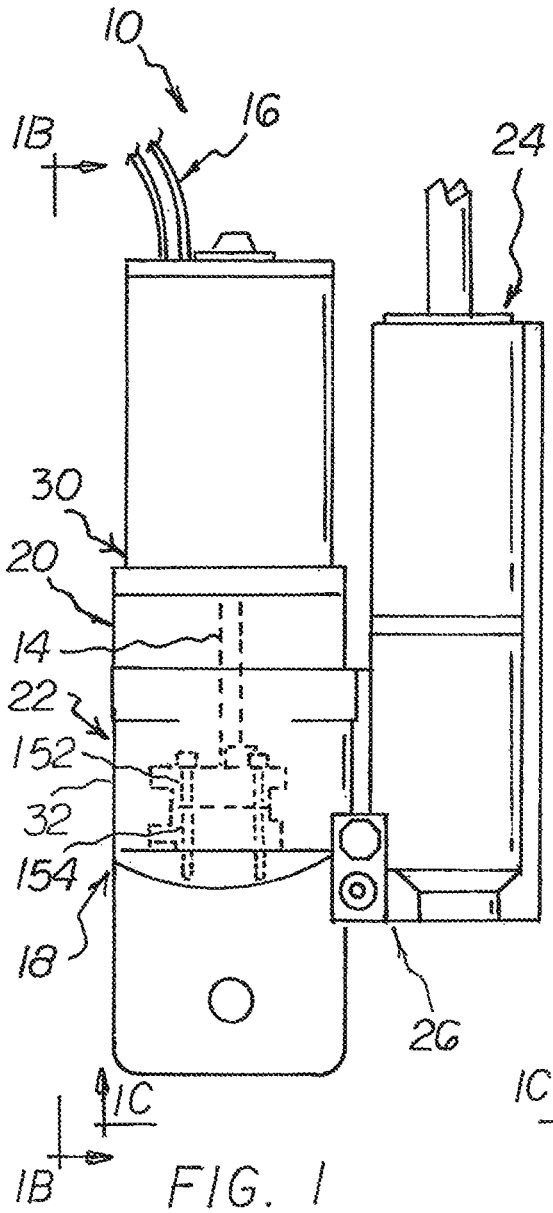
FIG. 1 is a front elevational view of the integrated side inflow and side outflow hydraulic pump.
Figure 1A:
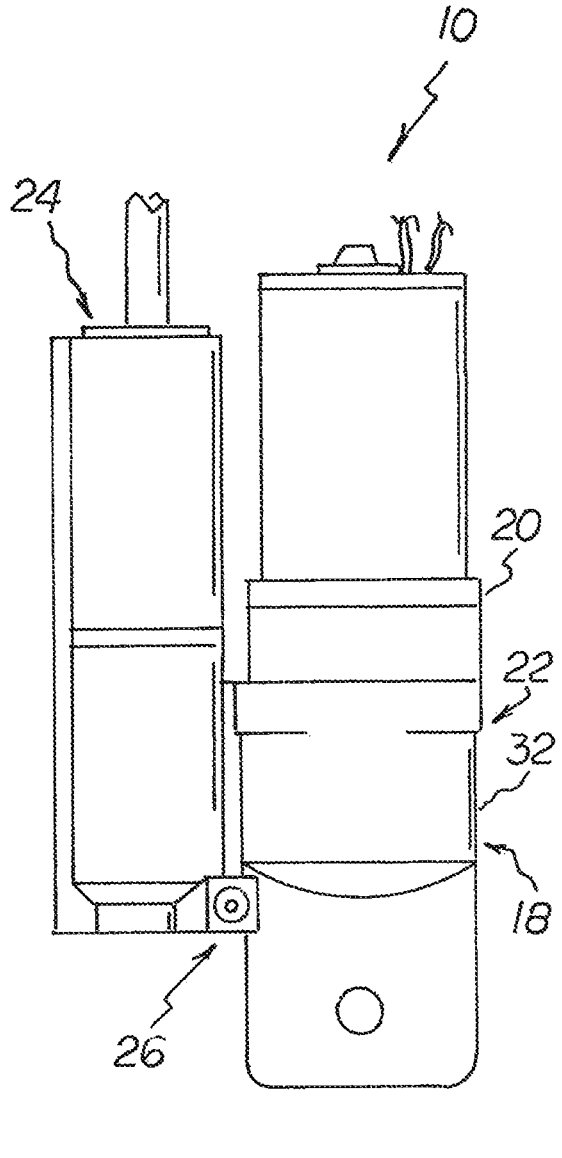
FIG. 1A is a rear elevational view of the device.
Figure 1B:
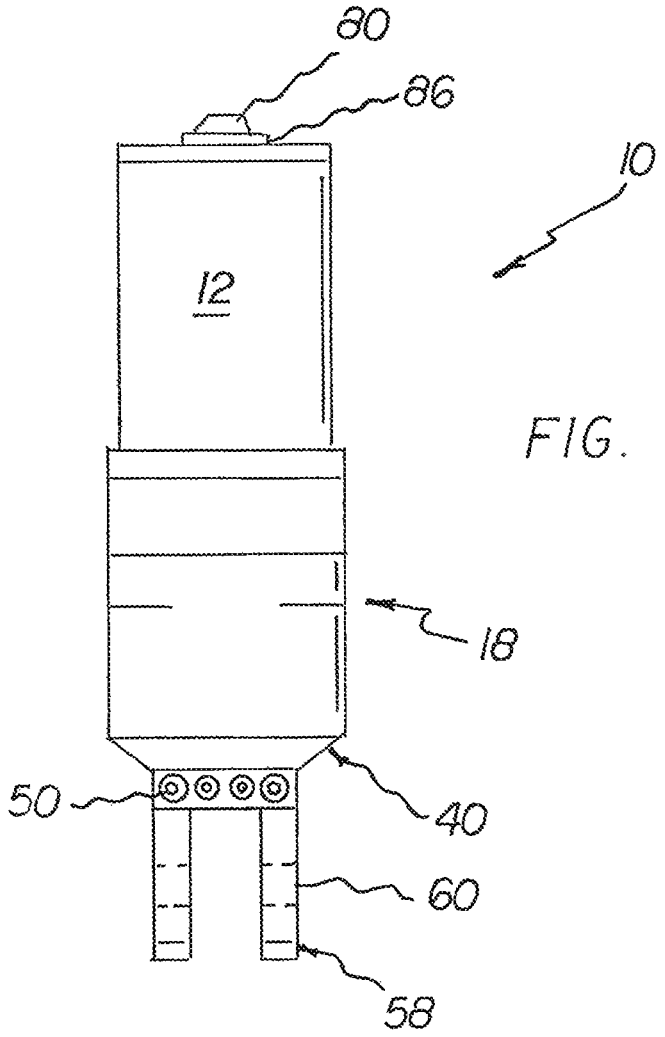
FIG. 1B is a right side elevational view of the device.
Figure 1C:
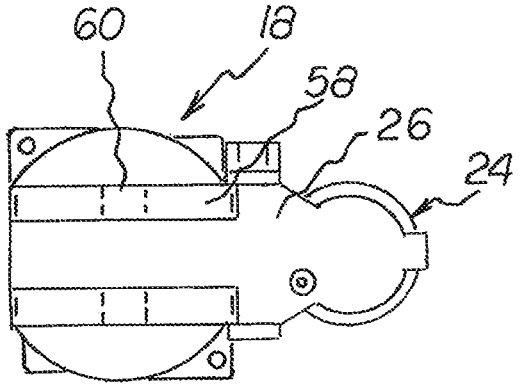
FIG. 1C is a bottom plan view of the device.
Figure 2:
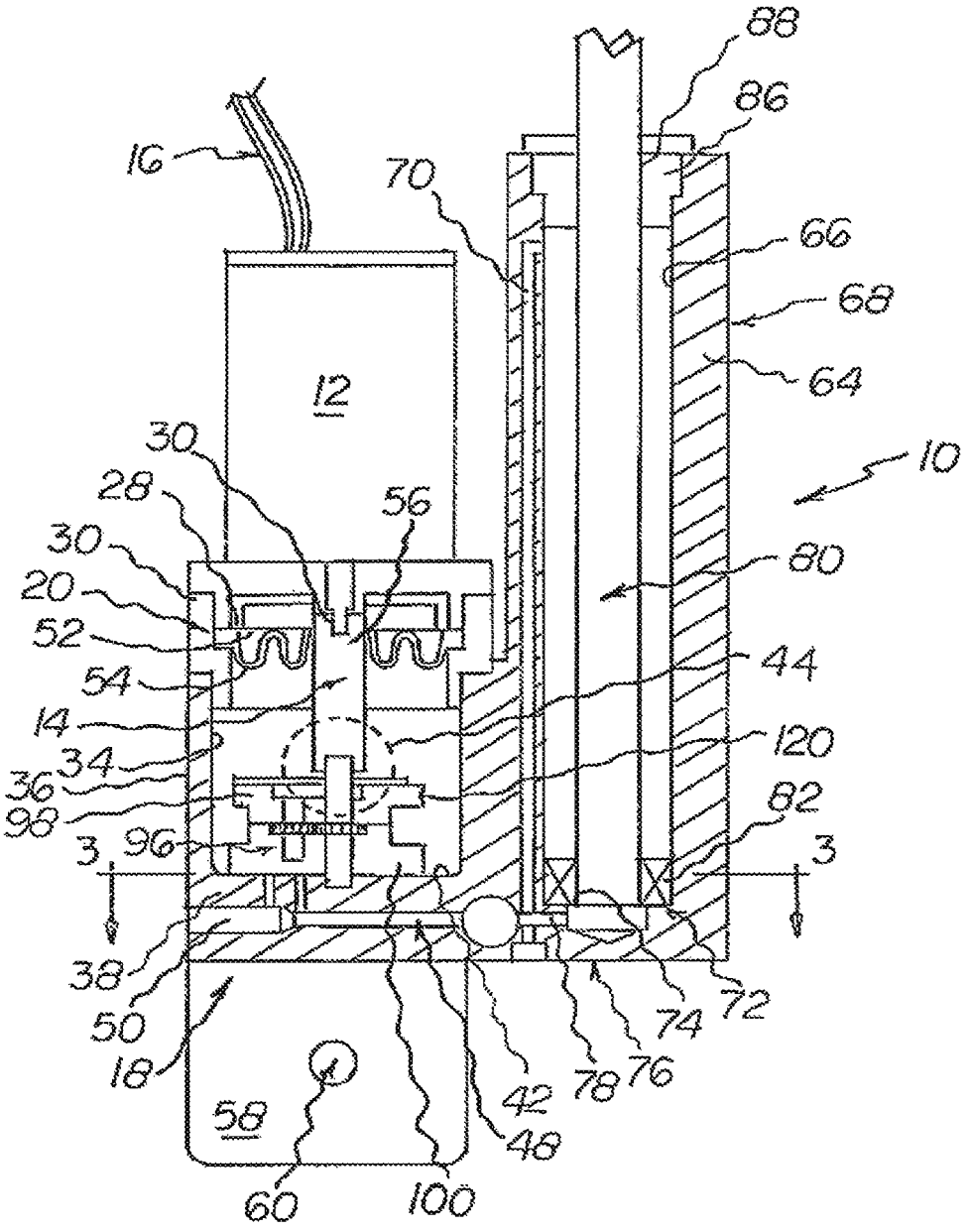
FIG. 2 is a cross sectional elevational view of the device.
Figure 3:
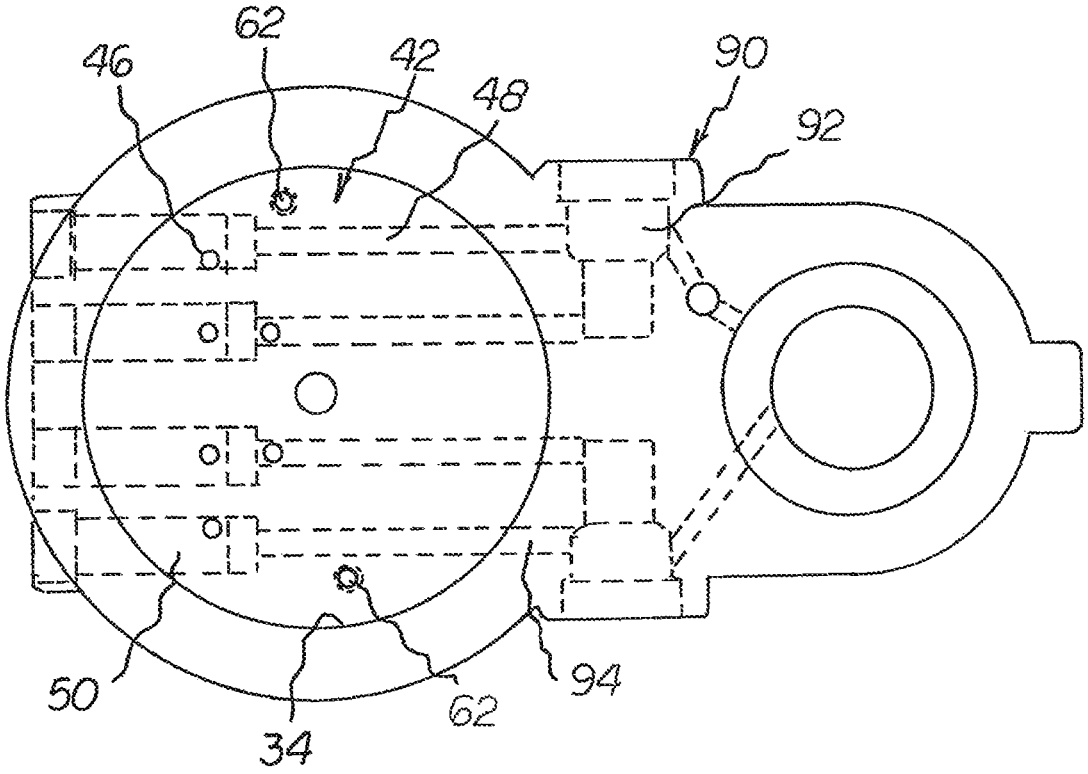
FIG. 3 is a view taken along line 3-3 of FIG. 2.
Figure 4:
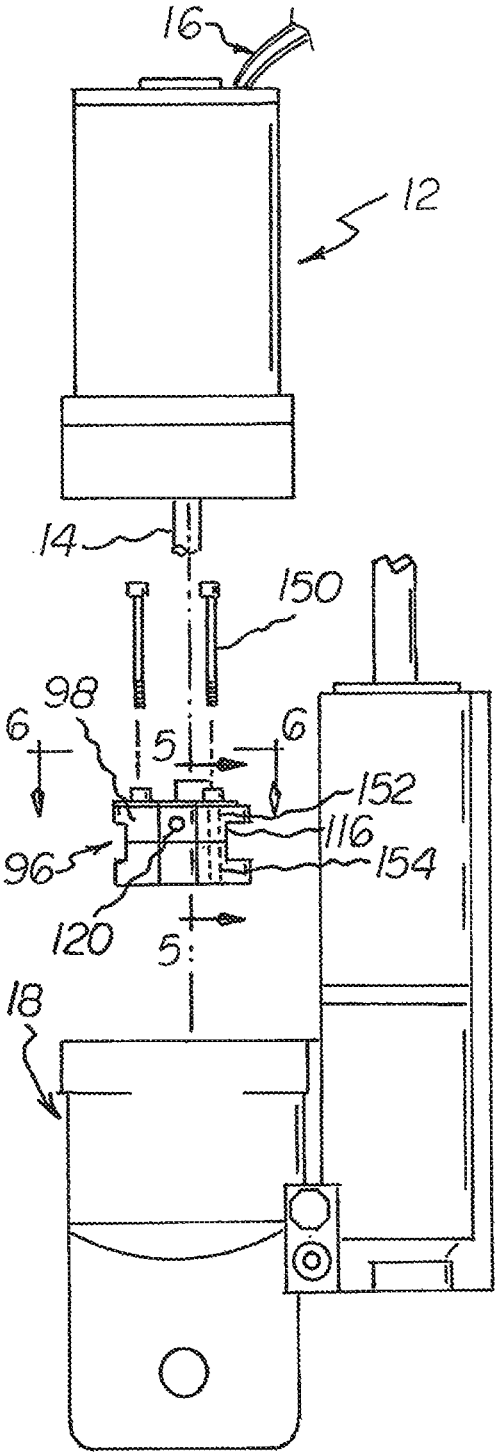
FIG. 4 is an exploded view of the device showing the motor, the pump, and the integrated housing.
Figure 5:
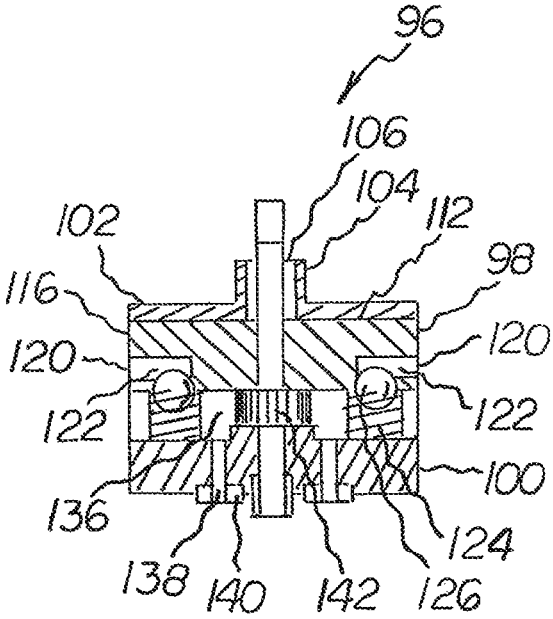
FIG. 5 is a view along line 5-5 of FIG. 4.
Figure 8:
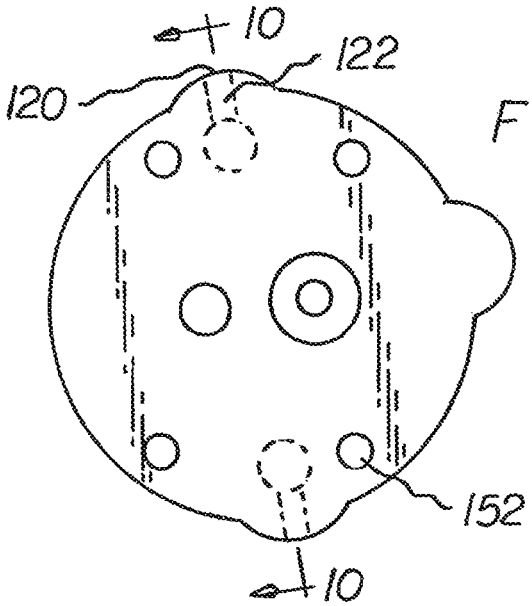
FIG. 8 is a view along line 8-8 of FIG. 7.
Figure 9:
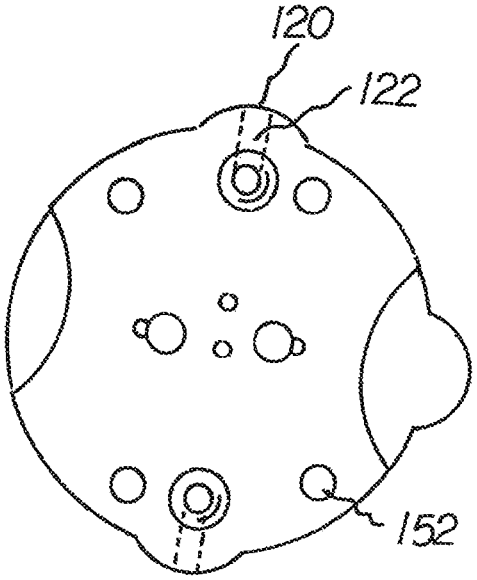
FIG. 9 is a view along line 9-9 of FIG. 7.
Figure 10:
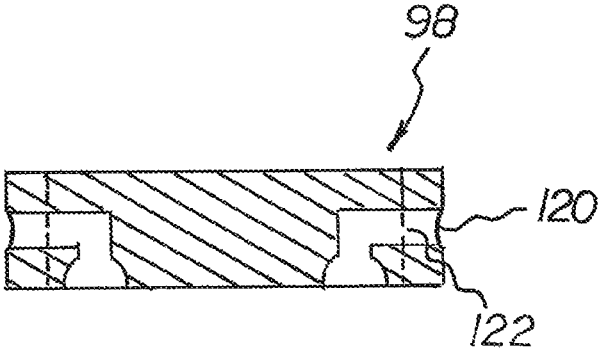
FIG. 10 is a view along line 10-10 of FIG. 8.

With reference now to the drawings, and in particular to FIG. 1 thereof, the preferred embodiment of the new and improved side inflow and side outflow hydraulic pump embodying the principles and concepts of the present invention and generally designated by the reference numeral 10 will be described.

The present invention, the side inflow and side outflow hydraulic pump 10 is comprised of a plurality of components. Such components in their broadest context include an integrated housing, a hydraulic pump contained within the housing, and a hydraulic cylinder. Such components are individually configured and correlated with respect to each other so as to attain the desired objective.

Herein described is a side inflow and side outflow hydraulic pump 10, comprising several components, in combination.

There is an electrically driven hydraulic pump motor 12. The electrically driven motor has a rotating motor output shaft 14. The motor has a electrical source, and is coupled there to by wires 16.

There is an integrated housing 18. The integrated housing has a motor connection portion 20, a pump housing portion 22, a hydraulic cylinder portion 24, and a connecting portion 26.

The motor connection portion has a motor mounting surface 28, with an upwardly projecting lip 30. The motor connection portion has a motor output shaft hole 31 there through.

The pump housing portion has a generally cylindrical outer wall 32 having a thickness. The thickness forms a housing portion inner surface 34 and a housing portion outer surface 36. The pump housing portion has a bottom 38. The bottom has an outer surface 40 and an inner surface 42, with a thickness there between. The pump housing portion has a centroid 44, that is, the volume center of the pump housing portion. The bottom surface of the pump housing portion has a plurality of fluid passageway 46 openings therein. The bottom thickness has a plurality of fluid passageways 48 there through. The pump housing portion bottom thickness has a plurality of flow valves 50 contained therein. The pump housing portion top surface has an opening 52, with a generally flexible seal 54. The flexible seal has a motor output shaft passageway 56 there through. The pump housing portion bottom outer surface has a pair of downwardly projecting coupling tabs 58 continuous there with. The downwardly projecting coupling tabs each have a bolt hole 60 there through. The bottom of the pump housing portion has a plurality of threaded bolt holes 62 there in.

The hydraulic cylinder portion has a generally cylindrical side wall 64 having a right side 65. The hydraulic cylinder portion side wall has an inner surface 66 and an outer surface 68, with a thickness there between. The hydraulic cylinder portion cylindrical right side wall has an upper fluid passageway 70 there through. The hydraulic cylinder portion has a bottom 72. The hydraulic cylinder portion has a centerline 73. The hydraulic cylinder portion bottom has an inner surface 74 and an outer surface 76, with a thickness there between. The bottom thickness of the hydraulic cylinder portion has a lower fluid passageway 78 there through. The hydraulic cylinder portion has a hydraulic ram shaft 80 and a piston 82. The hydraulic cylinder portion has an open upper end 84 with an associated cylinder cap 86. The cylinder cap has a hydraulic ram hole 88 there through.

The hydraulic cylinder portion has a generally flat lower extent, with the flat lower extent of the hydraulic cylinder portion providing a resting surface 89. The pump housing portion bottom outer surface pair of downwardly projecting coupling tabs are located off of the right side of the hydraulic cylinder portion resting surface and outside of the centerline of the hydraulic cylinder. The lower coupling tab of the pump housing lower surface fixedly couples the pump housing tabs to a location. The coupling tabs are located off-center of the hydraulic ram, and to the right of the hydraulic cylinder. Force from the cylinder is delivered to the resting surface, with the tabs holding the resting surface in a location.

The connecting portion is located between the pump housing portion and the hydraulic cylinder portion. The connecting portion is continuous with the pump housing portion and the hydraulic cylinder portion. The connecting portion has an outer surface 90 and a thickness. The connecting portion contains a plurality of fluid flow control valves 92 and a plurality of fluid passageways 94. The fluid passageways are continuous between the pump housing portion and the hydraulic cylinder portion.

There is a fluid pump 96. The fluid pump is housed within the pump housing portion. The fluid pump has an upper portion 98 and a lower portion 100 and a pump cap 102.

The fluid pump cap has a generally planar disc configuration with an upwardly projecting lip 104. The upwardly projecting lip of the fluid pump cap encircles a pump drive shaft hole 106 through the fluid pump cap. The fluid pump cap has a plurality of bolt holes 108 there through, with each bolt hole having an associated bolt 110.

The fluid pump upper portion has a generally disc shaped configuration with a top surface 112 and a bottom surface 114, with a thickness there between. The fluid pump upper portion has a continuous side surface 116. The top surface and the bottom surface are generally parallel to each other. The side surface has a pair of generally opposing recesses 118 therein. The side surface has oppositely located inflow-outflow openings 120 there in. The inflow-outflow openings are located orthogonally to the side recesses and are located outside of the centroid of the pump housing. The inflow-outflow openings each have an associated inflow-outflow fluid passageway 122 located within, and through, the thickness of the fluid pump upper portion. Each inflow-outflow fluid passageway has an associated check valve. Each check valve comprises a spring 124 and a ball 126.

The fluid pump lower portion has a generally disc shaped configuration. The fluid pump lower section has a generally flat upper surface 128, a generally flat lower surface 130, and a curved side wall 132 there between. The curved side wall has a plurality of outwardly projecting rounded tabs 134. The fluid pump lower portion has a thickness between the fluid pump lower portion upper surface and the fluid pump lower portion lower surface. The upper surface of the fluid pump lower portion has a pump gear recess 136 there in and a plurality of inflow-outflow holes 138 there through. The pair of inflow-outflow holes each run from the upper surface of the fluid pump lower portion to the lower surface of the fluid pump lower portion. Each inflow-outflow hole in the lower surface of the fluid pump lower portion has an associated O ring 140.

The fluid pump has a pump subassembly comprising a drive gear 142 and an idler gear 144. The drive gear has a drive shaft 146 coupled thereto. The idler gear has an idler shaft 148 coupled thereto. The drive shaft is coupled to the output shaft of the electrically driven motor.

The fluid pump cap bolts 150 couple the fluid pump cap, fluid pump upper portion and fluid pump lower portion to each other and to the threaded bolt holes in the bottom of the pump housing portion. The cap bolts pass through the fluid pump upper portion bolt holes 152 and through the fluid pump lower portion bolt holes 154.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A side inflow and side outflow hydraulic pump, comprising, in combination:

an electrically driven hydraulic pump motor having a rotating motor output shaft;

an integrated housing having a motor connection portion, a pump housing portion, a hydraulic cylinder portion and a connecting portion;

the pump housing portion having a bottom surface with the bottom surface of the pump housing portion having a plurality of fluid passageway openings therein, the bottom surface of the pump housing having a pair of downwardly projecting coupling tabs, the pump housing portion having a centroid, the bottom surface of the pump housing have threaded bolt holes therein;

the hydraulic cylinder portion having a cylindrical side wall having an inner surface and an outer surface with a thickness there between, the hydraulic cylinder having a right side cylindrical side wall and a left side cylindrical side wall, the hydraulic cylinder portion cylindrical right side cylindrical side wall having an upper fluid passageway there through, the hydraulic cylinder portion having a bottom with the hydraulic cylinder portion bottom having an inner surface and an outer surface with a thickness there between, the bottom thickness of the hydraulic cylinder portion having a lower fluid passageway there through, the coupling tabs of the pump housing being located off of a right side of the hydraulic cylinder, the outer surface of the bottom of the hydraulic cylinder having a flat resting surface;

the connecting portion being located between the pump housing portion and the hydraulic cylinder portion, the connecting portion being continuous with the pump housing portion and the hydraulic cylinder portion, the connecting portion having an outer surface and a thickness, the connecting portion containing a plurality of fluid passageways, the fluid passageways being continuous with and between the pump housing portion and the hydraulic cylinder portion;

a fluid pump being housed within the pump housing portion, the fluid pump having an upper portion and a lower portion with a thickness forming a continuous side surface, the side surface having oppositely located inflow-outflow openings there in, the inflow-outflow openings each having an associated inflow-outflow fluid passageway located within and through the thickness of the fluid pump upper portion;

the fluid pump lower portion having an upper surface having a pump gear recess there in and a plurality of inflow-outflow holes there through, the fluid pump lower portion having a lower surface;

the fluid pump having a pump subassembly comprising a drive gear and an idler gear, the drive gear having a gear with a drive shaft coupled thereto, the idler gear having a gear with an idler shaft coupled thereto, the drive shaft being coupled to the output shaft of the electrically driven motor; and a plurality of pump cap bolts coupling a fluid pump cap, the fluid pump upper portion and the fluid pump lower portion to each other and to the threaded bolt holes in the bottom surface of the pump housing portion.

2. The side inflow and side outflow hydraulic pump as described in claim 1, with the side inflow and side outflow hydraulic pump further comprising:

the fluid pump having an upper portion and a lower portion and the pump cap;

each inflow-outflow fluid passageway of the fluid pump having an associated directional check valve, with the directional check valve comprising a spring and a ball; and the pair of inflow-outflow openings of the fluid pump lower portion running from the upper surface of the fluid pump lower portion to the lower surface of the fluid pump lower portion and being located outside of the centroid of the pump housing portion.

3. The side inflow and side outflow hydraulic pump as described in claim 2, with the side inflow and side outflow hydraulic pump further comprising the pump housing bottom thickness having a plurality of fluid passageways there through.

4. The side inflow and side outflow hydraulic pump as described in claim 3, with the side inflow and side outflow hydraulic pump further comprising:

the motor connection portion having a motor output shaft hole there through;

the pump housing portion having a cylindrical outer wall having a thickness forming an inner surface and an outer surface, the bottom having an outer surface and an inner surface with a thickness there between;

the fluid pump cap having a planar disc configuration with an upwardly projecting lip, the upwardly projecting lip of the fluid pump cap encircling a pump drive shaft hole there through; and the fluid pump lower portion having a disc shaped configuration with a generally flat upper surface and a flat lower surface and a curved side wall there between, the fluid pump lower portion having a thickness between the fluid pump lower portion upper surface and the fluid pump lower portion lower surface, each inflow-outflow hole in the lower surface of the fluid pump lower portion having an associated O ring.

5. The side inflow and side outflow hydraulic pump as described in claim 4, with the side inflow and side outflow hydraulic pump further comprising:

the pump housing portion bottom thickness having a plurality of flow valves contained therein;

the pump housing connecting portion containing a plurality of fluid flow control valves there in; and the fluid pump upper portion having a disc shaped configuration with a top surface and a bottom surface, the top surface and the bottom surface being parallel to each other.

6. The side inflow and side outflow hydraulic pump as described in claim 5, with the side inflow and side outflow hydraulic pump further comprising:

the motor connection portion having a motor mounting surface with an upwardly projecting lip;

the pair of downwardly projecting coupling tabs being continuous with the pump housing portion bottom outer surface, the downwardly projecting coupling tabs each having a bolt hole there through, the bottom of the pump housing portion having a plurality of threaded bolt holes there in;

the hydraulic cylinder portion having a hydraulic ram with a shaft and a piston, the hydraulic cylinder portion having an open upper end with an associated cylinder cap, the cylinder cap having a hydraulic ram hole there through; and the curved side wall of the fluid pump lower portion having a plurality of outwardly projecting rounded tabs.

7. The side inflow and side outflow hydraulic pump as described in claim 6, with the side inflow and side outflow hydraulic pump further comprising:

the pump housing portion top surface having an opening with a flexible seal, with the seal having a motor output shaft passageway there through; and the fluid pump upper portion side surface having a pair of opposed recesses therein.

8. The side inflow and side outflow hydraulic pump as described in claim 7, with the side inflow and side outflow hydraulic pump further comprising:

the fluid pump cap having a plurality of pump cap bolt holes there through with each bolt hole having an associated pump cap bolt; and the inflow-outflow openings of the fluid pump upper portion being located orthogonally to the side recesses.

* * * * *